United States Patent [19]

Longardner

[11] Patent Number: 4,936,109

[45] Date of Patent: Jun. 26, 1990

[54] SYSTEM AND METHOD FOR REDUCING GAS COMPRESSOR ENERGY REQUIREMENTS

[75] Inventor: Robert L. Longardner, Indianapolis, Ind.

[73] Assignee: Columbia Energy Storage, Inc., Miami, Fla.

[21] Appl. No.: 166,773

[22] Filed: Mar. 4, 1988

Related U.S. Application Data

[63] Continuation of Ser. No. 915,791, Oct. 6, 1986, abandoned.

[51] Int. Cl.[5] ..... F25B 27/00

[52] U.S. Cl. ..... 62/238.3; 62/335; 62/476

[58] Field of Search ..... 62/6, 86, 87, 401, 148, 62/238.2, 238.3, 402, 335, 476

[56] References Cited

U.S. PATENT DOCUMENTS

| | | | |
|---|---|---|---|
| 678,487 | 7/1901 | Hill . | |
| 706,979 | 8/1902 | Martin . | |
| 1,883,921 | 10/1932 | Hull . | |
| 2,024,323 | 12/1935 | Wyld . | |
| 2,875,589 | 3/1959 | Horn | 62/87 |
| 2,979,923 | 4/1961 | Bury | 62/476 |
| 3,046,756 | 7/1962 | Whitlow et al. | 62/476 X |
| 3,287,928 | 11/1966 | Reid, Jr. | 62/476 X |
| 3,327,495 | 6/1967 | Ergenc | 62/401 |
| 3,824,804 | 7/1974 | Sandmark | 62/335 X |
| 3,892,499 | 7/1975 | Strub | 415/179 |
| 3,964,891 | 6/1976 | Krieger | 62/9 |
| 4,025,326 | 5/1977 | Leonard, Jr. | 62/335 X |
| 4,171,619 | 10/1979 | Clark | 62/335 X |
| 4,223,539 | 9/1980 | Webb et al. | 62/476 |
| 4,242,878 | 1/1981 | Brinkerhoff | 62/119 |
| 4,279,574 | 7/1981 | Kunderman | 62/238.6 X |
| 4,322,951 | 4/1982 | Alfano | 62/476 X |
| 4,373,346 | 2/1983 | Hebert et al. | 62/79 |
| 4,476,693 | 10/1984 | Johnson | 62/86 X |
| 4,554,799 | 11/1985 | Pallanch | 62/509 |

FOREIGN PATENT DOCUMENTS 0648750 2/1979 U.S.S.R. .

OTHER PUBLICATIONS

Trane Air Conditioning's Manual for 101-1660 Ton Single Stage Absorption/Refrigeration, Jan. 1982.

Trane Air Conditioning's Manual for 385-1060 Tons, 2 Stage Absorption/Refrigeration, Apr. 1981.

Trane Air Conditioning's Manual for 2-Stage Absorption Cold Generator, 1981.

*Primary Examiner*—Lloyd L. King

*Attorney, Agent, or Firm*—Woodard, Emhardt, Naughton, Moriarty & McNett

[57] ABSTRACT

An improved system for reducing the work required by a gas compressor in compressing a gas, comprising a gas compressor, a post-compression heat exchanger operably coupled to said gas compressor downstream therefrom to recover heat energy from a compressed amount of gas, and a means for reducing the work required by said gas compressor to compress a pre-compression amount of gas utilizing said recovered heat energy to provide cooling for the pre-compression amount of gas wherein such means includes an absorption chiller using the heat energy of compression to providing cooling for the gas to be compressed prior to compression.

27 Claims, 3 Drawing Sheets

SYSTEM AND METHOD FOR REDUCING GAS COMPRESSOR ENERGY REQUIREMENTS

This application is a continuation, of application Ser. No. 915,791, filed 10/6/1986, now abandoned.

BACKGROUND OF THE INVENTION

1. Field of the Invention

This invention relates to increasing efficiency of gas compression systems and more particularly to a system and method of using wasted heat energy from compression to increase the efficiency of the gas compression process.

2 Description of the Prior Art

Gas compressors have widespread application in industrial and domestic uses. Compressors provide a means of converting kinetic energy into potential energy. Kinetic energy is used to drive the compressor which in turn compresses the gas such that the compressed gas may be used at a later time to drive turbines or pneumatic tools, inflate tires, and for a variety of other applications. The kinetic energy is converted to potential energy and stored in the form of compressed gas much the way that a mechanical spring stores potential energy.

Unfortunately, the conversion process from kinetic energy to potential energy results in a waste of useful energy which leads to inefficiencies. As a gas is compressed, it is well known that the temperature of the gas increases as a result of the work of compression being done on the gas. This increased temperature can result in heat being lost from the compression system to the environment thereby wasting energy in the system.

In a compressor, there is an inlet pressure $P_1$ and inlet temperature $T_1$ of the gas prior to entering the compressor, and an outlet pressure $P_2$ and outlet temperature $T_2$ of the gas after compression. The theoretical interrelationship of these variables for ideal gas behavior is expressed by the relationship:

$$T_2=T_1(P_2/P_1)^X$$

where X is a constant, expressed in terms of $X=(\gamma-1)/\gamma$.

The term $\gamma$ is a the ratio of specific heat for a given gas, and both the inlet and outlet temperatures are expressed in terms of absolute temperatures. The work needed to compress an ideal gas for a given pressure ratio. $P_2/P_1$, varies directly with the inlet temperature $T_1$, and is expressed in the following relationship for ideal gas behavior:

$$\Delta H=C_pT_1[(P_2/P_1)^X-1]$$

where $\Delta H$ is the work of compression for an ideal gas, $C_p$ is the specific heat at constant pressure of the gas, and the other terms are the same as above in the previous equation. Thus, if the inlet temperature is reduced, the work required to attain a given pressure ratio is reduced.

Furthermore, when the gas to be compressed has a high humidity level, additional inefficiencies result. When for example, energy is spent to compress humid air which later cools to a temperature at which the water vapor in the air condenses, the energy used to compress the water vapor is wasted. By dehumidifying the air (or other gas) prior to compression, the overall efficiency of the compression system is increased since less energy is wasted compressing water vapor which eventually would be condensed out of the air. Typically, such condensation occurs in storage where the compressed gas cools as heat is transferred from the hot, compressed gas to the surrounding environment.

The prior art discloses cooling a gas prior to compression in order to reduce the work needed to achieve a given pressure ratio. U.S Pat. No. 678,487 to Hill discloses an air compressor which pre-cools a gas to be compressed. This is done by having the pre-compression gas pass through an ordinary cooler having a coolant supplied by outside means. Also, the prior art in U.S. Pat. No. 706,979 to Martin teaches the use of simultaneous cooling whereby water jackets use an outside cooling source to remove heat from air prior to and simultaneously with compression. Also in U.S. Pat. No. 4,242,878 to Brinkerhoff simultaneous cooling is achieved by surrounding the compressor's compression chamber with liquid, thereby cooling the compression process.

Pre-compression cooling has also been extended to include inter-cooling where several compressors are in series or where there is multi-staged compression. U.S. Pat. No. 2,024,323 to Wyld and U.S. Pat. No. 4,554,799 to Pallanch both disclose the use of inter-cooling where two compressors in series are employed in a closed refrigeration system. U.S. Pat. No. 3,892,499 to Strub discloses a multi-staged turbocompressor with cooling between stages to cool air prior to second-stage compression, while reheating the air just prior to second-stage compression to vaporize any water droplet and thereby reduce condensate forming on the compressor blades.

At the post-compression end of the compressor the hot, compressed gas emerges. U.S. Pat. No. 4,279,574 to Kunderman discloses a system to heat buildings with the heat given off from the compressed gas. However, this system is of limited utility in that it is only useful where there is a building to be heated, and then only where climate requires such building to be heated.

In view of the foregoing, it would be a significant advance in the art to convert the post-compression heat into pre-compression cooling. In this way, the compression system could be made intrinsically more efficient, without dependence on external cooling systems or external heating requirements. However, it is counterintuitive to one skilled in the art of compressors to use heat to cool. Yet, that is a result which the present invention achieves. It would also be a significant advance to use post-compression heat to dehumidify the gas, rather than merely revaporize water droplets, prior to compression.

SUMMARY OF THE INVENTION

The present invention relates to an improved system for reducing the work required by a gas compressor in compressing a gas comprising a first heat exchanger operably coupled to the gas compressor downstream therefrom to recover heat energy from a compressed portion of the gas; a means for reducing the work required by the gas compressor utilizing the withdrawn heat energy to provide cooling for the pre-compression portion of the mass of gas.

It is therefore an object of this invention to provide a gas compression system in which wasted heat from compressed gas is used to provide the energy to pre-cool intake gas to the compressor. One means of using the heat energy to provide cooling is by way of an absorption chiller. An absorption chiller, which is foreign to gas compression art, is a device which employs thermal energy, frequently from steam, to energize a staged process of concentration, condensation, evaporation, and absorption to provide a chillant for external use.

Another object of this invention is to provide a more efficient system for compressing a gas. This efficiency is intrinsic to the system of this invention, requiring a relatively small investment of external energy to realize the increase in compression efficiency.

Another object of this invention is to provide a means to dehumidify a gas prior to compression using the heat energy from post-compression gas.

Another object of this invention is to introduce the use of absorption chillers as a component part of a means to increase gas compressor efficiency.

Another object of this invention is to provide an overall reduction in work and power needed by a system for compressing and storing gas. Such stored, compressed gas's use includes, but is not limited to, providing means to drive power generation turbines to provide additional electrical power during peak demand periods. Such system may include, but is not limited to, storage systems such as the PACER ™ storage system as developed by Longardner & Associates, Inc. of Indianapolis, Ind.

These and other objects, features, and aspects of the present invention will become more fully apparent from the following description and claims taken in conjunction with the accompanying drawings.

DESCRIPTION OF THE PREFERRED EMBODIMENTS

Figure 1:
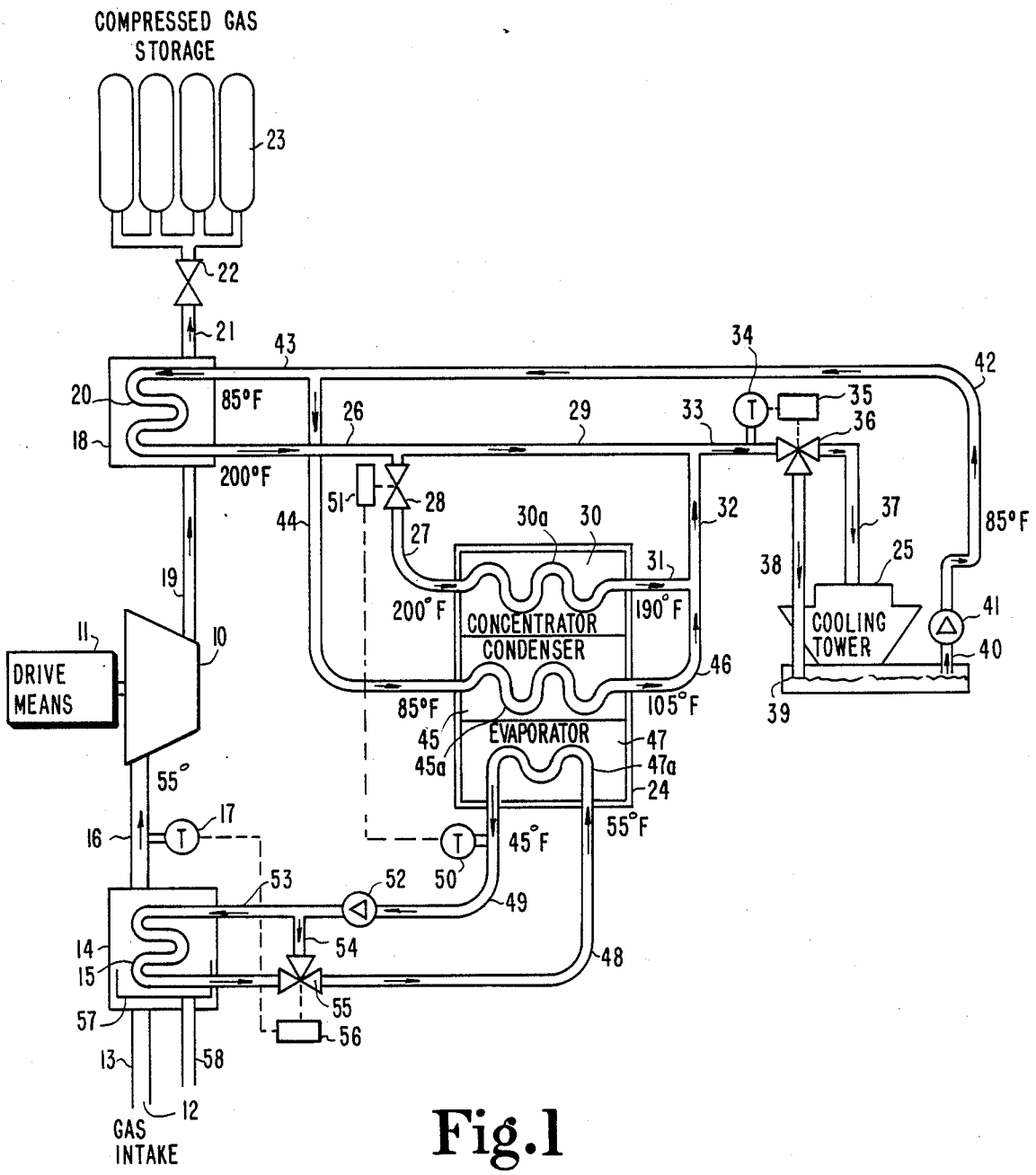
FIG. 1 is a schematic flow diagram of a preferred embodiment of the system for reducing gas compressor energy requirements.

Referring to FIG. 1, the compressor (10) driven by drive means (11) is used to compress a gas received through the gas intake (12). The drive means (11) in the preferred embodiment is a steam turbine engine, but alternatively could be an electric motor, internal combustion engine, or other engine for delivering power to the compressor (10). The gas travels into the gas intake (12) and through the gas intake line (13) passing through the pre-compression heat exchanger (14) whereby heat energy is removed from the gas by heat transfer into the pre-compression heat exchanger cooling coils (15). The gas travels through the pre-compressor line (16) whereby its temperature is measured by the pre-compressor thermometer (17). The gas travels into the compressor (10) wherein the gas is compressed. The gas travels from the compressor (10) to the post-compression heat exchanger (18) through the post-compressor line (19). In the post-compression heat exchanger (18) heat is extracted from the compressed gas by a process of heat transfer into the post-compression heat exchanger cooling coils (20). The gas then passes through the compressed gas exhaust line (21) to a place where the compressed gas is to be used or stored. Such use or storage may include the storage valve (22) and compressed gas storage means (23). The compressed gas may also be used immediately rather than stored. Heat exchange in both the pre-compression heat exchanger cooling coils (15) and post-compression heat exchanger cooling coils (20) is accomplished by using an absorption chiller (24) in conjunction with a cooling tower (25). Heat energy to actuate the absorption chiller (24) is obtained from the heat energy transferred in the post-compression heat exchanger (18) by means of a liquid delivery system. The post-compression heat exchanger cooling coils (20) contain water which transfer the heat energy removed in the post-compression heat exchanger (20). The water travels through the post-compression heat exchanger return line (26) whereby the heated water is channelled into the concentrator supply line (27) through the concentrator supply line control valve (28). Water from the post-compression heat exchanger return line (26) is also channelled through the absorption chiller bypass line (29). The absorption chiller (24) operates under standard principals of absorption chilling machines, and although multiple embodiments of absorption chillers are produced and available on the market, two such embodiments are shown in the drawings, either of which is considered the best mode of the present invention. In FIG. 1 the heated water in the concentrator supply line (27) flows through the concentrator (also known as a generator) (30) wherein it heats an aqueous solution of ammonia ($NH_3$) by way of heat transfer from the concentrator heat exchange coil (30*a*). The ammmonia gas migrates from the concentrator (30) into the condenser/absorber (45). The heating of the aqueous solution reduces the solubility of the ammonia in the solution and liberates the ammonia in a gaseous form inside the concentrator (30). The heated Water from the concentrator supply line (27) remains separated from the aqueous ammonia solution and exits the concentrator (30) through the concentrator exit line (31) wherein it travels through the absorption chiller return line (32) and joins with an water in the absorption chiller bypass line (29) into the cooling tower delivery line (33) wherein its temperature is monitored by the cooling tower delivery line thermometer (34) which is coupled to the cooling tower bypass control device (35) which controls the cooling tower bypass valve (36). Such cooling tower bypass valve (36) controls the flow of water through both the cooling tower delivery line (37) and the cooling tower bypass line (38). The flow of water through the cooling tower delivery line (37) and the cooling tower bypass line (38) is apportioned dependant upon the temperature of the water in the cooling tower delivery line (33). If the water in the cooling tower delivery line (33) needs cooling, it will be delivered to the cooling tower (25) through the cooling tower delivery line (37). Otherwise, the water will be delivered to the cooling tower basin (39) directly from the cooling tower bypass line (38). The water is held in the cooling tower basin (39) until it is pumped through the cooling tower draw line (40) through the cooling tower pump (41) and returned to the post-compression heat exchanger (18) by way of the cooling tower supply line (42). The water flow through the cooling tower supply line (42) is apportioned between the post-compression heat exchanger supply line (43) and the condenser supply line (44). The cooled water from the cooling tower (25) which is in the condenser supply line (44) enters the condenser/absorber (45) wherein heat from the vaporized ammonia gas which was liberated in the concentrator (30) is removed by way of heat transfer into the condenser heat exchange coil (45*a*), thus condensing the ammonia gas into liquid ammonia. The water from the condenser supply line (44) is heated in the condenser heat exchange coil (45*a*) and is discharged from the condenser-/absorber (45) into the condenser return line (46) wherein it joins the water from the concentrator exit line (31) and flows into the absorption chiller return line (32).

The absorption chiller (24) also contains the evaporator (47) wherein the liquid ammonia supplied from the condenser/absorber (45) is evaporated into gaseous ammonia in the presence of the evaporator heat exchange coil (47*a*) containing water from the chillant return line (48). The water in the chillant return line (48) is cooled by the evaporation of the liquid ammonia in the evaporator (47). The cooled water exits the evaporator (47) through the chillant supply line (49) wherein its temperature is measured by the chillant supply line thermometer (50). The chillant supply line thermometer (50) is coupled with the concentrator supply line control mechanism (51) which controls the concentrator supply line control valve (28). Thus, by monitoring the temperature of the chillant water in the chillant supply line (49) by means of the chillant supply line thermometer (50), the concentrator supply line control mechanism (51) and the concentrator supply line control valve (28) regulate the flow of hot water into the concentrator (30), thereby regulating the amount of energy supplied to the absorption chiller (24). As the amount of energy supplied to the absorption chiller (24) is increased, the cooling capacity of the absorption chiller (24) is increased. The water in the chillant supply line (49) is pumped by the chillant pump (52) into the pre-compressor heat exchanger supply line (53) and may be partially apportioned into the pre-compressor heat exchanger bypass line (54). The apportionment of chillant water flow between the pre-compressor heat exchanger supply line (53) and the pre-compressor heat exchanger bypass line (54) is controlled by the pre-compressor heat exchanger control valve (55) which is actuated by the pre-compressor heat exchanger control mechanism (56). The pre-compressor heat exchanger control mechanism (56) is coupled to the pre-compressor thermometer (17) thereby regulating the amount of chillant water flow into the pre-compression heat exchanger cooling coils (15) as a function of the gas temperature in the pre-compressor line (16).

The dehumidifier (57) operates to collect water condensate removed from the gas to be compressed during pre-cooling in the pre-compression heat exchanger (14). The condensate is then removed from the system through the dehumidifier drain (58).

Figure 2:
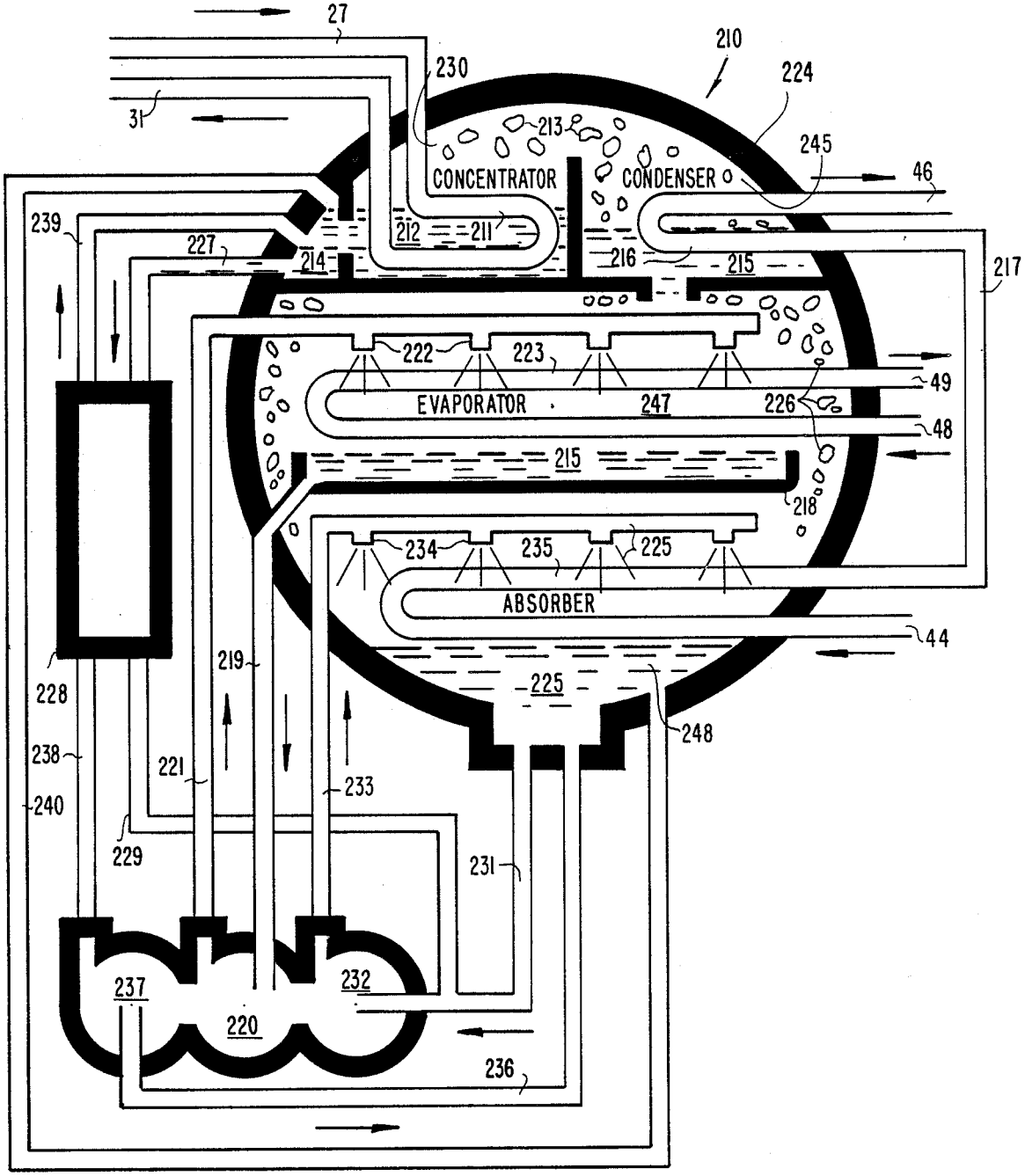
FIG. 2 is an elevational schematic flow diagram of an alternative embodiment of an absorption chiller used in FIG. 1.

FIG. 2 illustrates a refrigeration generator (224), an alternative embodiment to the absorption chiller (24) disclosed in FIG. 1. The function of refigeration generator (224) in the overall system shown in FIG. 1 is the same as the the function of absorption chiller (24) in FIG. 1, namely to provide a refrigerating chillant in the chillant supply line (49) using heat energy supplied from the concentrator supply line (27). In FIG. 2 the refigeration generator (224) is based on a design of an refrigeration generator (absorption chiller) currently manufactured by TRANE Air Conditioning Division of the TRANE Company, La Crosse, Wis. 54601. The TRANE refrigeration generator Model Nos., ABSC-01A through ABSC-016C as illustrated in TRANE's manual entitled *Adsorption Cold Generator* (DS ABS-1 January, 1982) are typical of such refrigeration generators and are hereby incorporated by reference. Likewise alternative embodiments such as TRANE's two-stage absorption cold generators as shown in their publication entitled *Two-stage Adsorption Cold Generator* (D ABS-2 April, 1981) are also incorporated by reference as alternative means of using heat energy to provide a refrigerant. Either the refrigeration generator (224) or the absorbtion chiller (24) may be considered the best mode and currently neither has been produced in conjunction with this invention.

The refigeration generator (224) in FIG. 2 comprises an outer shell (210) containing four chambers: the concentrator (230), the condenser (245), the evaporator (247) and the absorber (248). Heat energy is supplied from steam or hot water flowing through the concentrator supply line (27) into the concentrator (230). In the concentrator (230) heat transfer occurs across the concentrator heating coils (211) whereby a dilute solution (212) is heated such that a liquid component of the solution is vaporized into the first vapor (213) and the dilute solution (212) is concentrated into a concentrated solution (214). The dilute solution (212) may constitute a variety of solvents and solutes. Typically TRANE Air Conditioning Division uses a solution of lithium bromide dissolved in water to form the dilute solution (212). Thus the first vapor (213) would constitute water vapor. However since water boils at 212° Fahrenheit at atmospheric pressure, the temperature of the heated steam or water in the concentrator heating coils (211) would have to be at least that high in order to vaporize the water solvent. Thus, where such temperatures are below the boiling point of water it is often preferable to use a mixture of water and ammonia dissolved in that water to constitute the dilute solution (212). This is effective since ammonia's solubility in water decreases substantially as the temperature of the dilute solution (212) approaches the boiling point of water. In this way ammonia gas is liberated to form the first vapor (213) even when the temperature in the concentrator heating coils (211) is below the boiling point of water. The first vapor (213) is drawn into the condenser (245) wherein it is condensed into liquid solvent (215) due to the cooling action of the condenser cooling coils (216). Cooling in the condenser cooling coils (216) is provided by cooling water delivered from the absorber-condenser delivery line (217) which in turn is supplied cool water from the condenser supply line (44). The cooling water in the condenser cooling coils (216) exits the condenser (245) and is returned to the condenser return line (46). The liquid solvent (215) is delivered to the evaporator pan (218) and then drawn into the evaporator pan line (219) through the evaporator pump (220) and into the evaporator orifice line (221). The liquid solvent (215) then passes through the evaporator orifices (222) and is sprayed into the evaporator (247) across the evaporator heating coils (223). The evaporator (247) is maintained at a low pressure to assist in evaporating the liquid solvent (215) into the second vapor (226). Furthermore, heat energy extracted from the water floWing into the evaporator heating coils (223) from the chillant return line (48) provides heat energy to assist the evaporation of the liquid solvent (215) into the second vapor (226).

As a result the water leaving the evaporator (247) through the chillant supply line (49) is cooler than when it entered from the chillant return line (48). The cooled water in the chillant supply line (49) is used to provide cooling in the pre-compression heat exchanger (14), shown in FIG. 1. The second vapor (226) migrates into the absorber (248) wherein it is absorbed into an intermediate solution (225) thus causing the dilute solution (212) to be reconstituted. The intermediate solution (225) is created by mixing the concentrated solution (214) with the dilute solution (212). This is accomplished by drawing the concentrated solution (214) out of the concentrator (213) through the concentrated solution draw line (227) passing it through the absorption chiller heat exchanger (228) wherein the concentrated solution (214) is cooled, through the concentrated solution delivery line (229) and mixing it with dilute solution (212) from the absorber (248) delivered through the absorber mix delivery line (231). The newly formed intermediate solution (225) is then pumped through the intermediate solution pump (232) and into the absorber orifice line (233). The intermediate solution is then sprayed into the absorber (248) through the absorber orifices (234). The spray of intermediate solution (225) through the absorber orifices (234) increases the surface area of the intermediate solution (225) by forming the intermediate solution (225) into droplets, thereby increasing the absorption of second vapor (226) into the intermediate solution (225). Heat of absorption is removed through heat transfer into the absorber cooling coils (235) which is cooled from cooling water supplied from the condenser supply line (44). In the absorber, the dilute solution (212) is reconstituted and collected. The dilute solution (212) is drawn through the dilute solution recirculating line (236) into the recirculating pump (237) and is delivered to the absorption chiller heat exchanger (228) through the recirculating pump delivery line (238) In the absorption chiller heat exchanger (228) the dilute solution (212) from the recirculating pump delivery line (238) is pre-heated, thus reducing the amount of heat energy to liberate the first vapor (213) in the concentrator (230). After the dilute solution (212) passes through the absorption chiller heat exchanger (228) it is returned to the concentrator (230) in the dilute solution supply line (239). Thus the dilute solution (212) is recirculated back to the concentrator (213) and the staged process of concentration, condensation, evaporation and absorption is repeated. Pressure relief in the concentrator (230) is provided by connecting the concentrator (230) and the absorber (248) with the equilibrium line (240).

As disclosed above, alternative embodiments of absorption chillers are available. One such embodiment involves a two-staged concentration process in which concentration in the concentrator (230) is accomplished in two separate concentrator chambers. However the principals underlying these absorption chillers are the same as shown in the drawings and disclosed in the specification and are variations of what is disclosed. Likewise, these principals are the same as employed in the absorption chiller (24) in FIG. 1. The absorption chiller (24) in FIG. 1 embodies a three-stage absorption chiller wherein the functions of the absorber (248) and the condenser (245) in FIG. 2 are combined into a singular structure, the condenser/absorber (45) in FIG. 1.

Figure 3:
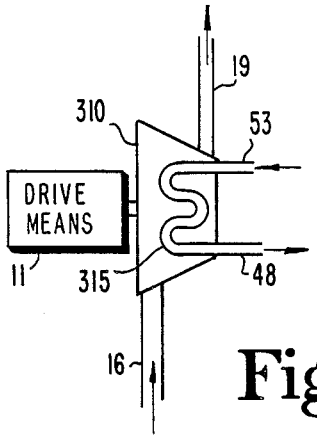
FIG. 3 is a schematic flow diagram of an alternative embodiment of a gas compressor used in FIGS. 1 and 4 having an integrated cooling coil.

FIG. 3 illustrates a compressor (310) which is an alternative embodiment to the compressor (10) in FIG. 1. In FIG. 3, compressor (310) has a compressor cooling coil (315) as an integral part of the compressor (310) which allows cooling of the gas to be compressed simultaneously with compression. Furthermore, the compressor cooling coil (315) may be used to extract heat generated from the mechanical action of the compressor (310) itself. The compressor (310) and the compressor cooling coil (315) may be used either in lieu of or in conjunction with the pre-compressor heat exchanger (14) and the pre-compressor heat exchanger cooling coils (15) as illustrated in FIG. 1. Also, the compressor (310) and compressor cooling coil (315) may be used in lieu of or in conjunction with the post-compressor heat exchanger (18) and the post-compressor heat exchanger cooling coils (20) as illustrated in FIG. 1. Furthermore, given the use of both the compressor cooling coil (315) in FIG. 3 and the pre-compressor heat exchanger (14) in FIG. 1 being used simultaneously, this specification also discloses using using a structure with the compressor cooling coil (315) and the pre-compressor heat exchange cooling coil (15) in continuous series to provide both pre-cooling and simultaneous cooling of the gas to be compressed.

Figure 4:
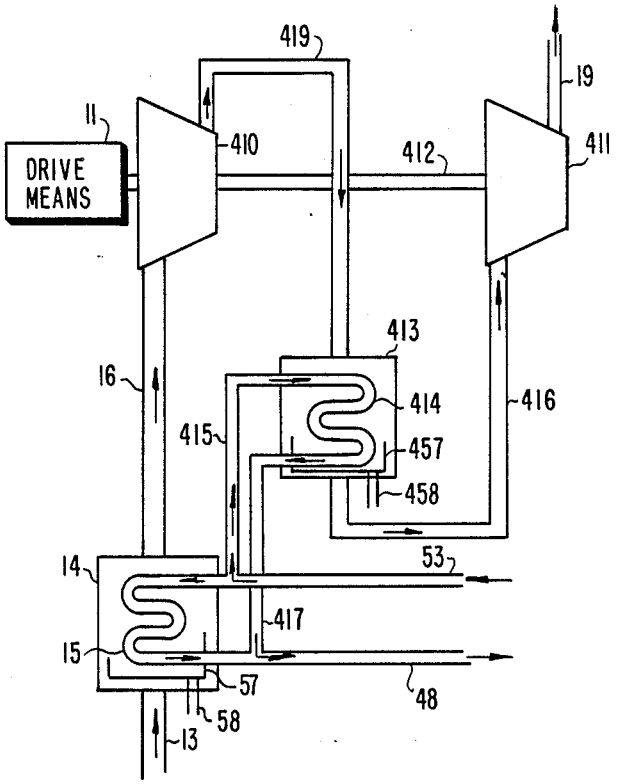
FIG. 4 is a schematic flow diagram of an alternative embodiment of the gas compressor arrangement in FIG. 1.

FIG. 4 shows an alternative system arrangement having a plurality of compressors in series. First-stage compressor (410) and second-stage compressor (411) are arranged in series to provide multi-staged compression. Power to the compressors is delivered by drive means (11) including the drive means shaft (412). Note that the first-stage compressor (410) and the second-stage compressor (411) could be driven by separate drive means rather than the singular drive means (11). The gas to be compressed is delivered in the pre-compressor line (16) to the first-stage compressor (410) for compression. The gas has been pre-cooled in the pre-compressor heat exchanger (14). After compression in the first-stage compressor (410) the compressed gas is delivered to the inter-stage heat exchanger (413) by way of the first-stage post-compressor line (419). In the inter-stage heat exchanger (413). heat is removed from the gas to be compressed by a process of heat transfer into the inter-stage heat exchanger cooling coils (414). The compressed gas exits the inter-stage heat exchanger (413) by way of the second-stage pre-compressor line (416) and is then further compressed in the second-stage compressor (411). After compression in the second-stage compressor (411) the compressed gas exits in the post-compressor line (19) and rejoins the system as depicted in FIG. 1. Cooling in the inter-stage heat exchanger (413) is provided by delivering chillant water to the inter-stage heat exchanger cooling coils (414) through the inter-stage heat exchanger supply branch (415) which in turn is fed by the pre-compressor heat exchanger supply line (53). The chillant water exits the inter-stage heat exchanger cooling coils (414) into the inter-stage heat exchanger return branch (417) wherein it joins the chillant water in the chillant return line (48). Given the disclosure in FIGS. 1 and FIGS. 4, it would be a logical extension to employ a multi-staged system having a plurality of more than two compressors. Furthermore, if given FIG. 4 it would also be possible to arrange the chillant water flow in the pre-compression heat exchanger cooling coils (15) and the inter-stage heat exchanger cooling coils (414) in series rather than in parallel as depicted in FIG. 4. Also given the disclosure in FIGS. 3 and 4, a possible permutation would be an arrangement having multi-staged compression with both simultaneous cooling as in FIG. 3 and pre-cooling and inter-cooling as in FIG. 4 with the cooling being provided by the absorption chiller (24) or alternatively the refrigeration generator (224). Another permutation would be to use the disclosed invention with a plurality of absorption chillers (24) and or refrigeration generators (224) to supply cooling where one or more compressors is being employed. Furthermore, it would also be possible to employ this invention using a plurality of compressors arranged in parallel rather than in series.

The dehumidifier (57) operates to collect water condensate removed from the gas to be compressed during pre-cooling in the pre-compression heat exchanger (14). The condensate is then removed from the system through the dehumidifier drain (58). The inter-stage dehumidifier (457) operates to collect water condensate removed from the gas to be compressed during pre-cooling in the pre-compression heat exchanger (14). The condensate is then removed from the system through the inter-stage dehumidifier drain (458).

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are within the scope and intent of the claims herein.

What is claimed is:

1. An improved system for reducing the work required by a gas compressor in compressing a gas, comprising:
   (a) a gas compressor;
   (b) a post-compression heat exchanger operably coupled to said gas compressor downstream therefrom to recover heat energy from a compressed amount of gas; and
   (c) a means for reducing the work required by said gas compressor to compress a pre-compression amount of gas utilizing said recovered heat energy to drive a refrigeration system to provide cooling for the pre-compression amount of gas.

2. The system of claim 1 wherein said reducing means includes a pre-compression heat exchanger upstream of said compressor and operably coupled therewith to lower the temperature of the gas before being compressed by said compressor.

3. The system of claim 1 wherein said reducing means includes an internal heat exchanger operably integrated with said compressor to lower the temperature of the gas simultaneously with compression of the gas in said compressor.

4. The system of claim 2 further comprising a gas storage means downstream of and operably coupled to said compressor.

5. The system of claim 2 wherein said reducing means includes said refrigeration system operably coupled to said post-compression heat exchanger wherein a staged process of concentration by vaporization, condensation, evaporation and absorption occurs, said post-compression heat exchanger providing energy to said refrigeration system, said refrigeration system operably coupled to said pre-compression heat exchanger to lower the temperature of the gas to be compressed by said compressor.

6. The system of claim 2 wherein said reducing means includes an absorption chiller operably coupled to said post-compression and pre-compression heat exchangers.

7. The system of claim 6 and further comprising:
   a means including a cooling tower for dissipating the heat energy from said absorption chiller.

8. The system of claim 6 and further comprising:
   a bypass means including a cooling tower for dissipating a portion of the heat energy from said post-compression heat exchanger, such portion not utilized by said absorption chiller.

9. The system of claim 6 and further comprising:
   a gas storage means downstream of and operably coupled to said post-compression heat exchanger.

10. The system of claim 2 and further comprising:
   a dehumidifying means operable within said pre-compression heat exchanger wherein water vapor is condensed out of the gas flowing through said pre-compression heat exchanger.

11. The system of claim 5 and further comprising:
   a gas storage means downstream of and operably coupled to said post-compression heat exchanger.

12. The system of claim 5 and further comprising:
   a bypass means including a cooling tower for dissipating a portion of the heat energy from said post-compression heat exchanger, such portion not employed in said reducing means.

13. The system of claim 5 and further comprising:
   a generation chamber wherein said concentration by vaporization occurs, and
   a second dissipating means for dissipating excess heat energy from said generation chamber, said second dissipating means including a cooling tower.

14. The system of claim 3 wherein said reducing means includes said refrigeration system operably coupled to said post-compression heat exchanger wherein a staged process of concentration by vaporization, condensation, evaporation and absorption occurs, said post-compression heat exchanger providing energy to said refrigeration system, said refrigeration system operably coupled to said internal heat exchanger to lower the temperature of the gas being compressed by said compressor.

15. The system of claim 3 wherein said reducing means includes an absorption chiller operably coupled to said post-compression and internal heat exchangers.

16. The system of claim 15 and further comprising:
   a means including a cooling tower for dissipating the heat energy from said absorption chiller.

17. The system of claim 15 and further comprising:
   a bypass means including a cooling tower for dissipating a portion of the heat energy from said post-compression heat exchanger, such portion not utilized by said absorption chiller.

18. The system of claim 15 and further comprising:
   gas storage means downstream of and operably coupled to said post-compression heat exchanger.

19. The system of claim 14 and further comprising:
   a generation chamber wherein said concentration by vaporization occurs, and
   a means including a cooling tower for dissipating excess heat energy from said generation chamber.

20. The system of claim 3 wherein said reducing means includes a pre-compression heat exchanger upstream of said compressor and operably coupled therewith to lower the temperature of the gas before being compressed by said compressor.

21. An improved system for reducing the work required by a multi-staged gas compressor in compressing a gas, comprising:
   (a) a multi-staged gas compressor having a plurality of compression stages;

(b) a plurality of inter-stage heat exchangers operably coupled with said compression stages to recover heat energy from a compressed amount of gas:

(c) a means for reducing the work required by said multi-staged gas compressor to compress an amount of gas utilizing said recovered heat energy to drive a refrigeration system to provide cooling for the pre-compression amount of gas.

22. The system of claim 21 wherein said reducing means includes an absorption chiller operably coupled to said inter-stage heat exchangers.

23. The system of claim 22 wherein said reducing means includes a pre-compression heat exchanger upstream of said multi-staged compressor and operably coupled therewith to lower the temperature of the gas before being compressed by said multi-staged compressor.

24. The system of claim 23 and further comprising:

a gas storage means downstream of and operably coupled to said multi-staged compressor.

25. The system of claim 23 and further comprising:

a dehumidifying means operable within said pre-compression heat exchanger wherein water vapor is condensed out of the gas flowing through said pre-compression heat exchanger.

26. The system of claim 1 and further comprising:

a gas storage means downstream of and operably coupled to said post-compression heat exchanger; and a gas intake for providing the gas to said compressor.

27. The system of claim 26 and further comprising:

a dehumidifying means operably coupled with said reducing means wherein water vaper is condensed out of the gas.

* * * * *